United States Patent [19]

Smith

[11] Patent Number: 4,566,980

[45] Date of Patent: Jan. 28, 1986

[54] CARPET TREATING COMPOSITION

[75] Inventor: James A. Smith, Old Tappan, N.J.

[73] Assignee: Creative Products Resource Associates, Ltd., Clifton, N.J.

[21] Appl. No.: 692,646

[22] Filed: Jan. 16, 1985

[51] Int. Cl.[4] ..... D06M 11/00

[52] U.S. Cl. ..... 252/8.6; 252/88; 252/140; 252/174.13; 252/174.17; 252/174.24

[58] Field of Search ..... 252/8.6, 88, 140, 528, 252/174.13, 174.17, 174.24

[56] References Cited

U.S. PATENT DOCUMENTS

| | | | |
|---|---|---|---|
| B 433,707 | 3/1976 | Froehlich et al. | 252/544 |
| 2,789,953 | 4/1957 | Blackman | 252/88 |
| 3,242,092 | 3/1966 | Bechtold | 252/140 |
| 3,533,953 | 10/1970 | Mills et al. | 252/88 |
| 4,035,148 | 7/1977 | Metzger et al. | 252/140 |
| 4,161,449 | 7/1979 | Smith et al. | 252/8.6 |
| 4,194,993 | 3/1980 | Deal | 252/541 |
| 4,244,834 | 1/1981 | Schwalley et al. | 252/88 |
| 4,395,347 | 7/1983 | McLaughlin et al. | 252/88 |
| 4,434,067 | 2/1984 | Malone et al. | 252/88 |
| 4,440,661 | 4/1984 | Takeuchi et al. | 252/88 |
| 4,493,781 | 1/1985 | Chapman et al. | 252/88 |

*Primary Examiner*—Paul Lieberman
*Assistant Examiner*—Willie J. Thompson
*Attorney, Agent, or Firm*—Merchant, Gould, Smith, Edell, Welter & Schmidt

[57] ABSTRACT

A dry-type carpet treating composition is disclosed which comprises a blend of base particles comprising an inorganic carrier salt and an agglomerating agent, said base particles having adhered thereto an amount of a waxy polymeric coating effective to maintain the structural integrity of the base particles after they have been contacted with aqueous soil.

31 Claims, 6 Drawing Figures

CARPET TREATING COMPOSITION

BACKGROUND OF THE INVENTION

In recent years, a wide variety of dry carpet treating compositions have become available. One such composition is disclosed in U.S. Pat. No. 4,161,449, and comprises a blend of an inorganic salt carrier, an agglomerating agent such as starch, fragrance and an anti-static agent. In compositions such as those disclosed in U.S. Published Application No. B433,707, and in U.S. Pat. Nos. 4,434,067 and 4,194,993, the inorganic carrier salt is wholly or partially replaced by dry urea-formaldehye particles, which can function as absorbent carriers for cleaning solutions.

Although these compositions are designed to pick up dirt and leave a residue of fragrance or anti-static agent behind, they suffer from a number of disadvantages. In the first place, the use of fine particles of carrier salts or fragmented polymeric substances can lead to unacceptably high amounts of residual dust in and on the carpeting. This dust can soil shoes and clothing and give dark carpeting an unacceptable frosted look. Although dusting can be reduced by the addition of de-dusting agents such as mineral oils and glycol ethers, such agents can lead to increased soil adherence and counteract the cleaning and anti-soil properties of the powdered compositions.

In the second place, agglomerating agents such as starch, flour or talc are often employed to prevent undue scattering or "bounce" of the carrier and to promote even coverage upon application of the product to the carpeting. Such agents are disadvantageous in that they also act to promote clumping of the powdered product in the storage container, thus hampering its delivery, e.g. by sprinkling it from a perforated shaker. Finally, the dry-type products presently on the market which incorporate inorganic carrier salts cannot be used on damp or wet carpeting, such as that soiled by excreta, rainwater or food spills, since the salts partially dissolve and cake into a solid mass. Liquid-loaded plastic beads may be less severely affected by moisture, but since they are intended to deliver cleaning fluid to dry carpeting, they are ineffective in the presence of moisture.

Therefore a need exists for a particulate carpet treating composition which exhibits an affinity for wet soils, and which can deliver effective amounts of carpet conditioning and odoriferous adjuvants. Such a composition should also be easy to apply to the soiled carpeting and readily removable without frosting dry carpeting or caking on wet carpeting.

BRIEF DESCRIPTION OF THE INVENTION

The present invention is directed to a dry-type carpet treating composition which comprises base particles of an inorganic carrier salt and an agglomerating agent which have applied thereto one or more polymeric coating agents. The polymeric agent is applied to the base particles in an amount effective to substantially maintain the structural integrity of the base particles when they are contacted with water while not substantially inhibiting their ability to absorb water. The polymeric agent will comprise a wax and preferably a polar, film-forming polymeric latex such as an acrylic polymer. Preferably, the composition will also include effective amounts of an odoriferous agent such as fragrance and carpet conditioning agents such as anti-static/anti-soil agents, fiber emollients and the like.

Although, for the sake of concise description, the applied polymeric agent will be referred to as a "coating" on the base particles, the precise nature of the polymer-particle combination cannot be ascertained. However, treatment of the base particles as described hereinbelow has been found to greatly improve their performance in the present compositions, particularly in the presence of moisture and to enhance their ability to deodorize and condition soiled carpeting and freshen room air. When contacted with wet carpeting, the coated particles "wet out", becoming saturated with water, while maintaining their structural integrity, in that the absorbed water does not cause the particles to dissolve, cake or become adhered to the carpet fibers.

Furthermore, the polymeric coating material can act to lubricate the carpet fibers, improving their shine, slip and feel, even in the absence of additional fiber emollients. The coated particles also resist scattering or dusting, either upon application or removal from dry carpeting, while resisting clumping or bridging during storage.

When adjuvants such as fragrance, anti-static agents, fiber emollients and the like are combined with the polymeric coating material or post-added to the coated particles, it is believed that the coating inhibits the migration of the adjuvants into the interior of the base particles. Thus, the polymeric coatings enhance the delivery of carpet conditioning adjuvants to the carpet fibers. In particular, the slow release of fragrance from the present composition can permit substantially less of this expensive component to be employed than heretofore believed possible, while attaining equivalent or improved air freshening and carpet deodorizing.

DETAILED DESCRIPTION OF THE INVENTION

Inorganic Carrier Salt Particles

The base particles incorporated into the present carpet-treating composition will preferably comprise a major portion of inorganic salt carrier particles. The inorganic salts useful in the present invention may be selected from any of those commonly employed in dry-type carpet cleaners, such as sodium sulfate, sodium condensed phosphates, sodium metasilicate, sodium borate, sodium carbonate, sodium bicarbonate, sodium citrate, sodium nitrate and the like. When available, anhydrous and/or highly absorptive powdered or granular salt particles are preferred, such as sodium sulfate, sodium bicarbonate or mixtures thereof.

Agglomerating Agent

The base particles of the present composition can also incorporate an amount of a particulate agglomerating agent effective to allow the composition to be evenly applied to the carpeting, as by sprinkling, without undue bounce or scattering. When polymer-coated, as described hereinbelow, the agglomerating agent can also serve as a carrier for a portion of the fragrance and the carpet conditioning adjuvants such as the anti-static agents. Typical agglomerating agents include starch, silica powders, flours, talc, pumice, natural and synthetic clays and the like. Preferably the agglomerating agent will comprise a minor portion of the total weight of the base particles.

Useful starches may be selected from any of a wide variety of commercially-available products including but not limited to corn, potato, wheat, rice, waxy maize, sago, sorghum, arrowroot, tapioca or mixtures thereof. These raw starches typically have granules sized within the range of about 2–150 microns, as measured along the longest axis.

Polymeric Coating Agent

The present composition will also include a polymeric agent, which is applied to the base particles in an amount effective to maintain the structural integrity of the base particles in the presence of moisture while permitting them to absorb large amounts of aqueous soil. Even when fully water-saturated, the coated base particles do not significantly cake or bind the carpet fibers, but can be readily removed from the carpeting.

Useful polymeric coating agents will include one or more natural or synthetic waxes or wax analogs, including paraffin wax, montan wax, carnauba wax, beeswax, scale wax, ozokerite, Utah wax, microcrystalline wax such as plastic and tank bottom derived microcrystalline waxes, wax substitutes such as Fischer-Tropsch wax, polyalkylenes such as polyethylene, polypropylene, including blends and copolymers thereof.

For example, useful synthetic waxes include emulsions of polyethylenes such as those available from the Chemical Corporation of America, East Rutherford, N.J., under the designation Poly Emulsion®. These aqueous emulsion contain about 20–45% solids and exhibit viscosities of about 10–250 cps maximum. Perferred members of this series include 392N35, 540N30, 629N40 and 392N35, or members of the corresponding "A" series, where "N" or "A" indicates an emulsion which is nonionic or anionic in character, respectively, and where the number after "N" indicates the percentage of nonvolatile materials present. Other preferred synthetic waxes include members of the A-C® polyethylene series, particularly those polyethylenes which are water-emulsifiable due to oxidation (A-C® 316A) or copolymerization with minor amounts of polar monomers such as acrylic acid (A-C® 540, 540A, 40% solids; A-C® 580 and 5120, 20% solids) and vinyl acetate (A-C® 430 and 400). The A-C® polyethylenes are available from Allied Chemical Corporation, Morristown, N.J.

Although the wax component is believed to be primarily responsible for the desirable behavior of the present composition in the presence of water, it has been found preferable to include one or more polar, film-forming polymers in the polymeric coating composition. These polar polymers, many of which are commercially-available as aqueous solutions or dispersions (latexes) can be selected from the homopolymers or interpolymers comprising low molecular weight polar unsaturated monomers, e.g., those of the formula $CH_2{=}C(R)(R')$ wherein R is lower($C_1$–$C_4$)alkyl and R' is $CO_2X$, wherein X is H, $NH_4$ or an alkali metal salt; $CO_2NH_2$, CN, $CO_2R$ and the like. Representative members of this class include water-soluble or water-dispersable polyacrylics, polyacrylates, polyacrylamides, and the copolymers such as acrylic-acrylate, ethylene acrylate, acrylate-acrylamide, acrylamide-sodium acrylate, styrene-acrylamide, styrene-acrylate, styrene-methacrylate and the like.

Especially preferred for use in the present compositions are the acrylic polymers, which include polyacrylic acid, polymethacrylic acid, acrylic acid-methacrylic acid copolymers, hydrolyzed polyacrylamide, hydrolyzed polymethacrylamide, hydrolyzed acrylamide-methacrylamide copolymers, hydrolyzed polyacrylonitrile, hydrolyzed polymethacrylonitrile, hydrolyzed acrylonitrile-methacrylonitrile copolymers, or mixtures, thereof. Water-soluble salts or partial salts of these polymers such as the respective alkali metal (e.g. sodium, potassium) or ammonium salts can also be used. One such class of acrylic polymers are commercially-available as the 76 Res® series from Union Oil Company of California. This series of acrylics is available as aqueous solutions or dispersions comprising about 10–70% solids, e.g. 76 Res® 200 (40% solids, 50 cps viscosity, anionic particle charge), 76 Res® 6510 (65% solids, 500 cps, anionic charge) and 76 Res® 745 (40% solids, 50 cps, anionic charge).

When combined with the waxes, these polar, film-forming latexes can improve the flowability of the particulate composition and further reduce the solubility of the inorganic carrier salts. Preferably, a wax comprising a polyethylene or an acrylic acid-polyethylene copolymer will be applied in combination with an acrylic polymer in a ratio of wax to acrylic solids of about 0.75–10:1, respectively, most preferably about 1–3:1.

The polymeric coating may be further hardened by employing latexes which incorporate metal salt hardening (curing) agents such as the naphthenates of lead, cobalt and manganese, manganese octoate and the like or the common metal salts such as zinc oxide, zinc carbonate or those of the general formula $M(NH_3)_nY_2$ wherein M is zinc, cadmium, copper, nickel, cobalt, zirconium, chromium, manganese or calcium, n is the coordination number of the metal and Y is carbonate, citrate, acetate or formate. Such curing agents can be employed in amounts of about 0.1–5% of the aqueous polymeric coating composition.

Anti-Static Agent

It is also highly preferable that the present carpet treating compositions incorporate one or more materials which impart anti-static properties to the carpet fibers, and correspondingly reduce soil retention and re-deposition. Such compounds also impart anti-soil properties, which improve the long-term ease of carpet cleaning and maintenance. Particulate anti-static agents can be employed as components of the base particle blend, or may be post-added to the polymer-coated particles, while liquid anti-static agents are preferably post-added to the polymer-coated particles or combined with the polymeric coating component.

Preferred particulate anti-static agents include aluminum oxide, stearates such as aluminum stearate or mixtures thereof. Liquid anti-static agents include many of the commonly-employed nonionic and anionic surfactants. However, cationic amine surfactants such as quaternary or tertiary amines are particularly effective as anti-static agents in the present composition. These materials can also function as fiber emollients.

Cationic amines useful in the present invention include the N-(higher)$C_{14}$-$C_{24}$-alkyl-N-benzyl-quaternary ammonium salts which comprise water solubilizing anions such as halide, e.g., chloride, bromide and iodide; sulfate, methosulfate and the like and the heterocyclic imide such as the imidazolinium salts.

For convenience, the aliphatic quaternary ammonium salts may be structurally defined as follows:

$$(R)(R_1)(R_2)(R_3)N^+X^-$$

wherein R is benzyl, or lower(alkyl) benzyl; $R_1$ is alkyl of 10 to 24, preferably 12 to 22 carbon atoms; $R_2$ is $C_{10}$–$C_{24}$-alkyl or $C_1$–$C_4$-alkyl, $R_3$ is lower alkyl of 1 to 4 carbon atoms and X represents an anion capable of imparting water solubility or dispersibility including the aforementioned chloride, bromide, iodide, sulfate and methosulfate. Particularly preferred species of these aliphatic quats include n$C_{12}$–$C_{18}$-alkyl-dimethylbenzylammonium chloride (myrisalkonium chloride), n-$C_{12}$–$C_{14}$-alkyldimethyl(ethylbenzyl) ammonium chloride (quaternium 14), dimethyl(benzyl)ammonium chloride and mixtures thereof. These compounds are commercially available as the BTC series from Onyx Chemical Co., Jersey City, NJ. For example, BTC 2125M is a mixture of myrisalkonium chloride and quaternium-14.

Other useful aliphatic quats include the N,N-di-(higher)-$C_{10}$–$C_{24}$-alkyl-N,N-di(lower)-$C_1$–$C_4$-alkyl-quaternary ammonium salts such as distearyl(dimethyl)ammonium chloride, di-hydrogenated tallow(dimethyl-)ammonium chloride, di-tallow-(dimethyl)ammonium chloride, distearyl(dimethyl) ammonium methylsulfate, and di-hydrogenated-tallow(dimethyl)ammonium methyl sulfate.

Other useful quaternary ammonium anti-static agents include the acid salts of a higher(alkyl)-amido(lower)alkyl-(dialkyl)-amines of the general formula:

$$[A(C{=}O)—R—NH(R_1)(R_2)]^+X^-$$

wherein A is a $C_{14}$–$C_{24}$ normal or branched alkyl group, R is ethylene, propylene or butylene, $R_1$ and $R_2$ are both $C_1$–$C_4$-(lower)alkyl or together form the moiety —$CH_2$—$CH_2YCH_2$—$CH_2$—, wherein Y is NH, O or $CH_2$, and X is the salt of an organic acid. Compounds of this class are commercially available pfrom Croda, Inc., New York, NY, as the Incromate® series, e.g. Incromate® IDL [isostearamidopropyl(dimethyl)amine lactate], Incromate® ISML [isostearamidopropyl(-morpholinium)lactate] and Incromate® CDP [cocamidopropyl(dimethyl)amine propionate].

Other useful amine salts are the stearyl amine salts that are soluble in water such as stearyl amine acetate, stearyl amine hydrochloride, stearyl-dimethylamine hydrochloride, distearyl amine hydrochloride, decyl pridinium bromide, the pyridinium chloride derivative of the acetylaminoethyl esters of lauric acid, lauryl trimethyl ammonium chloride, decylamine acetate and bis[(oleoyl)-(5-8)-ethanoloxy]-tallow($C_{14}$–$C_{18}$)amine-hydrogen phosphate (Necon CPS-100) and the like.

Preferred imidazoliniums include: (methyl-1-tallowamido)ethyl-2-tallow imidazolinium methyl sulfate; available commercially from Sherex Chemical Co. under the tradename Varisoft® 475; and (methyl-1-oleylamido)ethyl-2-oleyl imidazolinium methyl sulfate; available commercially from Sherex Chemical Co. under the tradename Varisoft® 3690.

The $C_{14}$–$C_{24}$-alkylamidoalkyl-tert-amine salts have been found especially effective in imparting anti-static, anti-soil properties to the present carpet treatment compositions.

Odoriferous Agent

Minor but effective amount of a volatile odoriferous agent selected so as to be chemically-compatible with the above-described surfactants are preferably included in the aqueous phase to deodorize the carpet and freshen room air. Useful odoriferous agents include fragrances, including oils such as rose oil, lavender, lilac, jasmine, vanilla, wisteria, lemon, apple blossom, or compound bouquets such as citrus, spice, aldehydic, woody, oriental, and the like.

Minor amounts of coloring or other carpet conditioning adjuvants, e.g., additional fiber emollients such as silicone fluids, nonionic and anionic surfactants, and the like, may be introduced into the present compositions in effective amounts either via the aqueous polymeric phase or by treating the final product with the adjuvants as by spraying, mixing, etc. When employed in the present products, such adjuvants will commonly be present at a level of up to about 5–10% by weight of the finished product.

Therefore, preferred carpet-treating compositions of the present invention will comprise a blend of about 60–95%, most preferably about 70–90% base particles comprising about 40–85%, most preferably about 45–80% of one or more inorganic salt carriers and about 1–25%, most preferably 2–10% of an agglomerating agent, e.g. starch. The base particles have applied thereto a polymeric coating preferably comprising about 1–10%, preferably about 2.5–7.5% wax, e.g. a polyethylene or polypropylene wax and about 0.5–10%, preferably about 1–5% of a film-forming latex, e.g. an acrylic or acrylate polymer. The present compositions can also comprise about 1–10% aluminum oxide, aluminum stearate or mixtures thereof, about 0.05–10%, preferably about 0.1–5% of an amine anti-static agent and about 0.01–10%, preferably about 0.05–5% fragrance. Since the polymeric coating will commonly be applied to the base particles by contacting them with aqueous solutions or emulsion of the film-forming polymer or of the wax component, the finished composition will necessarily incorporate minor amounts of water, e.g. up to about 5–10% of water, which will be bound by the inorganic carrier salt as water of hydration.

Preparation

The compositions of the present invention can be prepared by blending the powdered carrier salts and agglomerating agent together using suitable mixing equipment. Vertical shift blenders such as the Glen powder mixer, the Hobart mixer or ribbon blenders are preferred since they can be readily adapted for the subsequent introduction of the liquid components.

The liquid polymeric coating agent is then added to a moving bed of the powder blend with continuous mixing, preferably in an incremental fashion. Although it is preferable to apply the polymer coating agent as a water-based emulsion or solution, the application of the wax, the latex or mixtures thereof in volatile organic solvent-based systems is also within the scope of the present invention. For the coating of laboratory-scale powder blends, the liquid polymeric components may be sprayed onto the stirred solid particles by means of a hand-operated pump sprayer. For the preparation of larger portions of the composition, the spray-coating step can be accomplished by pumping the aqueous polymeric emulsions or solutions from a suitable holding tank and atomizing the liquid stream, e.g. by a two-nozzle spray head. When aqueous emulsions or solutions of both a wax and a latex are employed, it is preferred that they be sprayed in combination. In the case of compositions which comprise polymeric agents which are capable of thermally cross-linking, the coated base particles can be heated for a period of time effective to cross-link the coating into a coherent film. Alternatively, the aqueous emulsion or solution of the polymer can be preheated to the extent necessary to partially cross-link the polymeric component prior to spray-coating it onto the base particles.

When aluminum oxide is incorporated into the present compositions, it can be added via the initial dry blend or added after introduction of the liquid polymeric components. In some cases, the post-addition of aluminum oxide can help to dry the composition and enhance its flow properties.

The anti-static agent, fiber emollient and/or fragrance are preferably added to the blend with continued agitation after the treatment of the base particles with the coating agents has been completed since these agents are intended to become adhered to the carpet fibers to perform their intended functions. To effectively provide the time-release of the fragrance from the small amount of residual composition which is entrained by the carpeting, it has been found preferable to incorporate a portion of the fragrance into the liquid polymeric component and to post-add a portion to the coated particles. Most preferably about 50% of the total fragrance will be incorporated into the composition via the polymer spray and about 50% will be post-added, e.g. by spraying, dropwise addition or the like.

When a substantial portion of the fragrance is thereby entrained in the polymeric coating, it has unexpectedly been found that, for a given fragrance, less of the fragrance is required to impart a residual air-freshening effect than when fragrance is mixed with uncoated carrier particles. For example, qualitative evaluations indicated that, while about 1–1.5% by weight of commercially-available fragrances, e.g. the Belmay series gave satisfactory residual air-freshening effects when mixed with uncoated carrier particles, only about 0.5–1.0% of fragrance was necessary to achieve equivalent performance levels when the carrier particles were prepared according to the processes of the present invention.

The resultant carpet treating granules are then stirred or tumbled until the absorption of the carpet conditioning agents is complete to yield a dry, free-flowing powder which can be sieved to ensure uniformity of particle size and packaged.

In use, the composition is applied to the wet carpet surface, as by scattering or sprinkling, to the desired amount and removed, as by vacuuming. To enhance the drying, conditioning and deodorizing effects of the composition, it can be contacted with the carpet fibers under conditions of pressure, as by sweeping or by contact with the beater-brush of a vacuum cleaner.

The invention will be further described by reference to the following detailed examples.

EXAMPLE I

Carpet Treating Composition

A. Preparation

The bowl of a Kenmore® bake mixer was charged with 982.1 g of anhydrous sodium sulfate (40 mesh), 290.0 g of sodium bicarbonate (40 mesh), and 72.54 g of Argo® corn starch and the mixture blended for 15 minutes at setting 8. Aluminum oxide (75.0 g, source?) was added with continued mixing over 5 minutes. The resultant flowable powder was sprayed with a mixture of 240.7 g of aqueous polyethylene emulsion (35% solids, Poly Emulsion® 392-N35), 103.8 g of an aqueous acrylic acid emulsion (40% solids, Union Oil 76 Res® 200 polymer) and 9 g of fragrance (Belmay 6781-5885-R) with continued mixing over 15–20 minutes. After an additional 30 minutes of mixing, 18.0 g of Incromate® ISML (25% actives) anti-static agent was sprayed onto the blend over 10 minutes, followed by an additional 9.0 g of the fragrance, with continuous mixing to yield a homogenous, dry, flowable powder.

B. Comparative Wet Carpet Treatment Test

Figure 1:
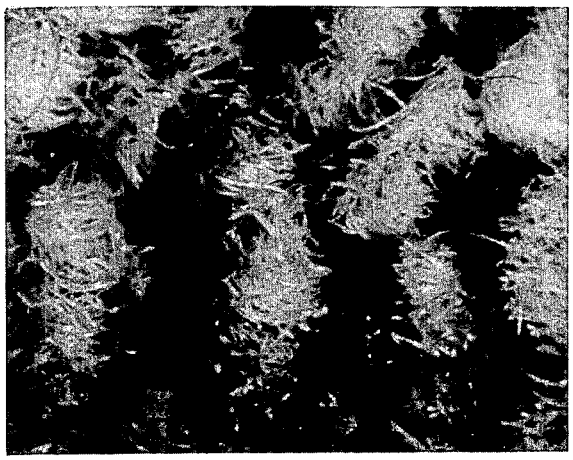
FIG. 1 is a photomicrograph (10× magnification) depicting the surface of dry, light tan, medium length pile, nylon fiber carpeting.
Figure 2:
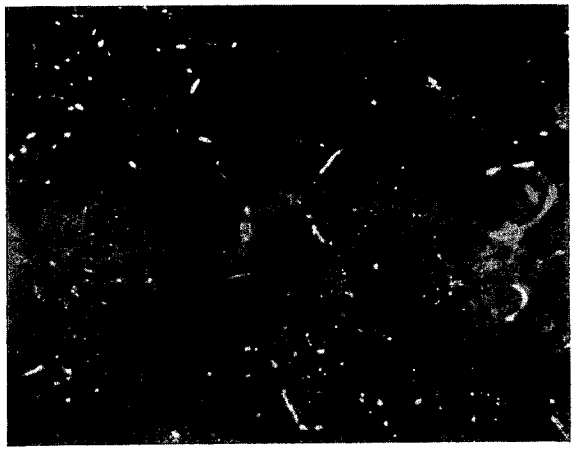
FIG. 2 is a photomicrograph (10×) of the surface of the carpeting sample depicted in FIG. 1 which has been saturated with water.
Figure 3:
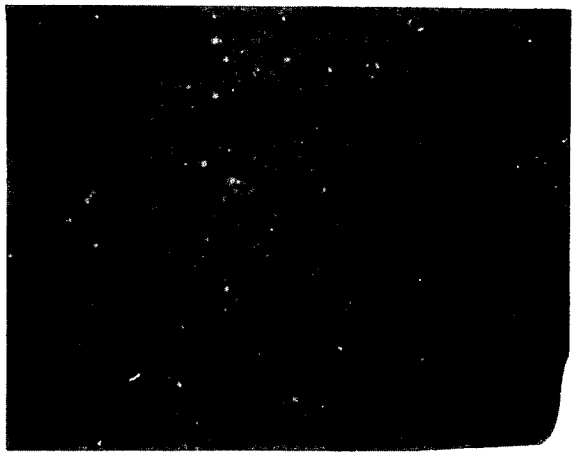
FIG. 3 is a photomicrograph (10×) depicting a portion of a 10.0 g sample of Carpet Fresh® (Ciba-Geigy) immediately following its application to the surface of the wet carpeting depicted in FIG. 2. The dry granules have formed a hard, cohesive mass which has fused to the carpet fibers.
Figure 4:
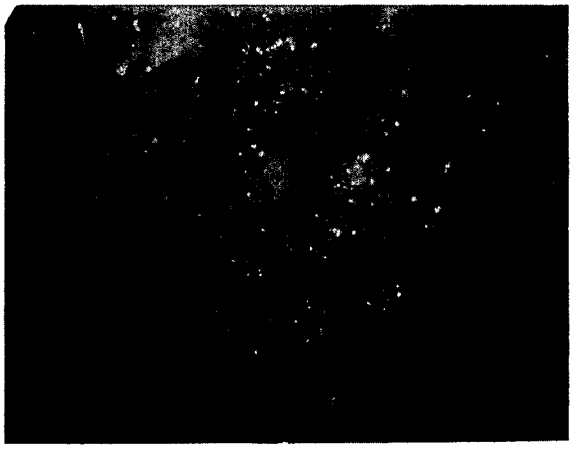
FIG. 4 is a photomicrograph (10×) of the Carpet Fresh® sample depicted in FIG. 3 which has remained adhered to the carpet after one pass with a Sears Kenmore Powermate® vacuum cleaner. The crust of the sample has cracked to reveal the carpet surface, but the sample remains firmly bound to the carpeting.
Figure 5:
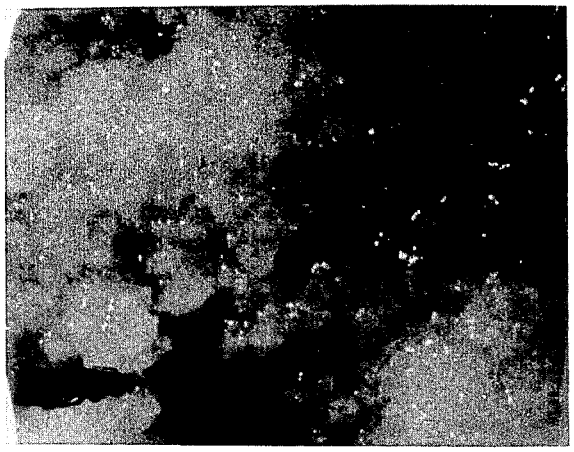
FIG. 5 is a photomicrograph (10×) depicting a sample of 10.0 g of the dry carpet treating composition of Example I which has been sprinkled onto the surface of water-saturated carpeting as depicted in FIG. 2. The granules have become wetted by the carpeting but have not hardened into a cohesive, adherent mass.
Figure 6:
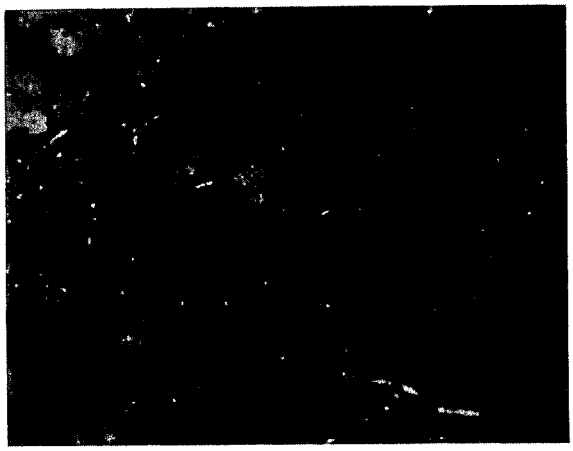
FIG. 6 is a photomicrograph (10×) depicting the treated carpet surface of FIG. 5 which has been exposed to one pass of the vacuum cleaner. The cleaning product granules have been substantially removed from the carpet fibers, which have also been partially dried.

When used to treat wet carpeting, the cleaning composition of Example I effectively lubricated and imparted anti-static properties to the carpeting and freshened the room air.

EXAMPLE II

The bowl of a Kenmore® cake mixer was charged with 1104 g of sodium sulfate and 80.6 g Amazo® 839 starch (American Maize) and the dry blend mixed for 15 minutes at setting 8. Sodium bicarbonate (322.6 g) was added, followed by 80.6 g of aluminum oxide. After 30 minutes a mixture of 193.1 g of an aqueous polyethylene emulsion (35% solids, Poly Emulsion® 392-N35), 193.1 g of an aqueous acrylic copolymer emulsion (40% solids, 76 Res® 200 polymer) was sprayed onto the blend with continued mixing over 30 minutes via a pump sprayer. Mixing was continued for another 30 minutes and the resulting flowable, dry powder was passed through a 30-mesh standard series screen.

To individual 296.1 g portions of the cleaner base were added 2.4 g (0.8%) portions of fragrance and 1.5 g (0.5%) portions of the following adjuvants: Necon® CPS-100 (55% actives), Dow 200 fluid (100 cps) and Croda Incromate® IDL. The ingredients were blended by tumbling in a rotary mixer for 30–35 minutes. The resultant carpet cleaning compositions were dry flowable powders which exhibited performance in wet carpeting similar to that exhibited by the composition of Example I.

EXAMPLE III

Table I summarizes additional carpet treating compositions which are prepared according to the procedure of Example I, except as otherwise noted.

TABLE I

| Ingredient | Example (Weight Percent) A | B | C++ | D++ |
|---|---|---|---|---|
| Sodium Sulfate | 55.65 | 54.70 | 54.50 | 55.25 |
| Sodium Bicarbonate | 16.13 | 16.11 | 16.00 | 15.15 |
| Starch | 4.03 | 4.03 | 4.01 | 4.07 |
| Aluminum Oxide | 4.03 | 4.03 | 2.30 | 5.19 |
| Fragrance | 0.81 | 0.80 | — | 0.81 |
| Wax Emulsion+ | 19.35 | 13.52 | 13.42 | 13.12 |
| Acrylic Copolymer Emulsion* | — | 5.81 | 5.76 | 5.64 |
| Anti-Static Agent** | — | 1.00 | 2.20 | 0.77 |
| Aluminum Stearate | — | — | 1.80 | — |

+Poly Emulsion 540-N30 (30% polyethylene) or Poly Emulsion 392-N-35 (35% polyethylene; Chemical Corp. of America).
*Union Oil 76 Res ® 200; 40% acrylic copolymer emulsion.
**Incromate ® ISML (25% solution).
++Aluminum oxide and stearate added after addition of acrylic acid-wax emulsion mixture. To form composition D, the acrylic-wax mixture was heated to 100–110° F. and sprayed onto the stirred powders over 20 minutes.

The compositions of Examples III A–D were flowable, dry powders with performance characteristics on wet carpeting similar to those exhibited by the cleaning composition of Example I.

The invention has been described with reference to various specific and preferred embodiments and techniques. However, it should be understood that many variations and modifications may be made while remaining within the spirit and scope of the invention.

What is claimed is:

1. A dry-type carpet treating composition comprising base particles of an inorganic carrier salt and an agglomerating agent, said base particles having applied thereto a polymeric coating comprising a film-forming latex and an amount of wax effective to substantially maintain the structural integrity of the base particles upon contact with water while not substantially inhibiting their ability to absorb said water.

2. The composition of claim 1 wherein said coating further comprises an acrylic polymer.

3. The composition of claim 1 wherein said composition further comprises an anti-static agent.

4. The composition of claim 3 wherein the anti-static agent comprises aluminum oxide, aluminum stearate or mixtures thereof.

5. The composition of claim 4 wherein said anti-static agent comprises the organic acid salt of a (higher)alkylamido(lower)alkylene-tert-amine.

6. The composition of claim 1 which further comprises an odoriferous agent.

7. The composition of claim 1 wherein the wax comprises polyethylene, an ethylene-acrylic acid copolymer or mixtures thereof.

8. The composition of claim 1 which further comprises a silicon fluid.

9. The composition of claim 1 wherein said inorganic carrier salt comprises sodium sulfate, sodium bicarbonate and mixtures thereof.

10. The composition of claim 1 wherein the agglomerating agent comprises starch.

11. A dry-type carpet treating composition comprising a blend of base particles comprising about 40–85% of one or more inorganic carrier salts and about 1–25% of a solid agglomerating agent, said base particles having adhered thereto a polymeric coating comprising about 1–10% wax and about 1–10% of a film-forming latex, said polymeric coating being effective to substantially maintain the integrity of the base particles upon contact with water while not substantially inhibiting their ability to absorb said water.

12. The composition of claim 11 wherein said wax comprises polyethylene or a copolymer of polyethylene with acrylic acid and said film-forming latex comprises an acrylic polymer.

13. The composition of claim 11 wherein said agglomerating agent comprises about 2–10% starch.

14. The composition of claim 11 wherein said carrier salt comprises sodium sulfate, sodium bicarbonate or mixtures thereof.

15. The composition of claim 11 which further comprises about 1–10% of a particulate anti-static agent.

16. The composition of claim 15 wherein said anti-static agent comprises aluminum oxide, aluminum stearate or mixtures thereof.

17. The composition of claim 11 further comprising about 0.1–5% of an amine anti-static agent.

18. The composition of claim 17 wherein the amine anti-static agent comprises an acid salt of a (higher)alkylamido-(lower)alkylene-(dialkyl)amine.

19. The composition of claim 11 further comprising about 0.01–10% fragrance.

20. The composition of claim 11 wherein said latex comprises an effective amount of a metal salt curing agent.

21. A flowable, powdered carpet treating composition formed by a process comprising:

(a) forming a dry blend of inorganic carrier salt particles and starch; and (b) mixing and coating said blend with a liquid polymeric coating composition comprising fragrance, a wax and a film-forming latex; said coated particles being capable of absorbing water while substantially retaining their structural integity.

22. The composition of claim 21 wherein the liquid coating composition comprises an aqueous emulsion or solution comprising the wax and the film-forming latex.

23. The composition of claim 21 which is formed by a process further comprising, after step (b), mixing said polymer-coated particles with an anti-static agent.

24. The composition of claim 21, which is formed by a process further comprising incorporating aluminum oxide, aluminum stearate or mixtures thereof into the dry blend of step (a).

25. The composition of claim 22 which is formed by a process comprising incorporating an aqueous emulsion of polyethylene, a polyethylene-acrylic acid copolymer or mixtures thereof into said polymeric coating composition.

26. The composition of claim 22 which is formed by a process comprising incorporating an aqueous solution or dispersion of an acrylic polymer into said polymeric coating composition.

27. The composition of claim 22 wherein said liquid polymeric coating composition is sprayed onto a moving bed of said blended particles.

28. The composition of claim 22 wherein said coated particles are heated for a period of time effective to cross-link said polymeric coating.

29. The composition of claim 22 wherein a portion of said fragrance is mixed with said coated particles after step (b).

30. A method of deodorizing and conditioning carpeting soiled with aqueous soil comprising contacting the surface of said carpeting with an effective amount of the compositions of claims 6, 19, or 21, and thereafter removing said composition.

31. The method of claim 30 wherein said composition is contacted with said aqueous soil for a period of time effective for the composition to become substantially saturated with said aqueous soil.

* * * * *